US007805809B2

(12) United States Patent
Salice

(10) Patent No.: US 7,805,809 B2
(45) Date of Patent: Oct. 5, 2010

(54) HINGE WITH PUSHING FORCE DURING OPENING FOR FURNITURE UNITS WITH CORNICE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 748 days.

(21) Appl. No.: 11/660,832

(22) PCT Filed: Aug. 24, 2005

(86) PCT No.: PCT/EP2005/054150

§ 371 (c)(1),
(2), (4) Date: Feb. 22, 2007

(87) PCT Pub. No.: WO2006/021563

PCT Pub. Date: Mar. 2, 2006

(65) Prior Publication Data

US 2007/0261203 A1 Nov. 15, 2007

(30) Foreign Application Priority Data

Aug. 26, 2004 (IT) ..... RM04U000139

(51) Int. Cl.
*E05F 1/14* (2006.01)

(52) U.S. Cl. ..... 16/284; 16/286; 16/335

(58) Field of Classification Search ..... 16/335, 16/284, 236–238, 286, 242, 281, 296
See application file for complete search history.

(56) References Cited

U.S. PATENT DOCUMENTS 3,744,086 A * 7/1973 Salice et al. ..... 16/302
3,864,786 A 2/1975 Salice et al.
4,716,622 A * 1/1988 DeBruyn ..... 16/297
5,027,474 A 7/1991 Bowers et al.
5,355,557 A * 10/1994 Cress et al. ..... 16/286

(Continued)

FOREIGN PATENT DOCUMENTS

EP 0 987 394 A 3/2000

(Continued)

OTHER PUBLICATIONS

International Search Report.

*Primary Examiner*—Chuck Y. Mah
(74) *Attorney, Agent, or Firm*—Collard & Roe, P.C.

(57) ABSTRACT

The invention relates to a hinge for furniture units with cornice, provided inside with a spring device suitable to produce a pushing force on the door in the opening direction, in such a way as to be coupled with a holding device, for example of the ratchet type, and avoid the use of handles or other grasping elements. This hinge, with a single pivot pin, has an elastic element or spring, of the flat or steel wire type, fixed in a box or furniture element integral with the door, capable of exerting a pushing force on a cam or projection analogous to the fixing arm of the hinge and disposed so as to obtain a moment in the opening direction. Advantageous variants include a cam constituted by a separate plastic element fixed to the arm of the hinge or by one or more tabs produced on the arm. Advantageously, the spring can exert the pushing force during opening directly on the box, on the back of the fixing arm or on the lateral ribs of the arm.

7 Claims, 4 Drawing Sheets

U.S. PATENT DOCUMENTS 5,369,841 A * 12/1994 Bembnowski ..... 16/278
5,517,724 A * 5/1996 Beneke ..... 16/335
5,604,956 A * 2/1997 Grass ..... 16/278
5,617,612 A * 4/1997 Ferrari et al. ..... 16/278
5,737,804 A * 4/1998 Ferrari et al. ..... 16/242
5,839,164 A * 11/1998 Cress et al. ..... 16/383
6,049,946 A * 4/2000 Cress et al. ..... 16/240
6,289,556 B1 * 9/2001 Salice ..... 16/335
6,360,401 B1 * 3/2002 Salice ..... 16/335
6,557,959 B1 5/2003 King
2004/0025293 A1 2/2004 Salice

FOREIGN PATENT DOCUMENTS

EP 1 367 203 A 12/2003

* cited by examiner

HINGE WITH PUSHING FORCE DURING OPENING FOR FURNITURE UNITS WITH CORNICE

CROSS REFERENCE TO RELATED APPLICATIONS

Applicant claims priority under 35 U.S.C. §119 of Italian Application No. RM2004U000139 filed Aug. 26, 2004. Applicant also claims priority under 35 U.S.C. §365 of PCT/EP2005/054150 filed Aug. 24, 2005. The international application under PCT article 21(2) was published in English.

DESCRIPTION

1. Field of the Invention

The present invention relates to a hinge for furniture units with cornice, in particular to a hinge with spring for doors, or in general for parts of furniture units suitable to be made to move.

2. State of the Art

American style furniture, that is, with a cornice which surrounds and delimits the span of the furniture unit, provided with doors which open by rotating about an axis, use various types of hinge. A type which is very widely used today is one in which the hinges to support the doors in the closed position are not visible from the outside of the furniture unit when the door is closed.

In the state of the art, known hinges are provided with springs of various types so as to generate a return force during closing of the doors on which they are fitted. This allows very precise closing of the doors on the furniture unit. Nonetheless, in these cases it is almost always necessary to exert an external force to open the door of the furniture unit, which involves the presence of a handle. At times doors without handles and without other grasping systems visible from the outside are preferred, which involves the use of a device with a spring capable of producing an opening moment on the door. In this case, either a spring separate from the hinge or hinges with a complex form are provided.

SUMMARY OF THE INVENTION

A main object of the present invention is to produce a hinge for American style furniture units with cornice, provided inside with a spring device suitable to produce a pushing force on the door in the opening direction, in such as way as to be coupled with a holding device, for example of the ratchet type, and avoid the use of handles or other grasping elements.

A further object is to produce a hinge with a limited production cost, consequently with a simple shape and construction, and which offers versatility in use.

Accordingly, the present invention reaches the aforesaid objectives by means of a hinge for furniture units with cornice having the characteristics of claim 1.

This hinge, with a single pivot pin, has an elastic element or spring, of the flat or steel wire type, fixed in a box or furniture element integral with the door, capable of exerting a pushing force on a cam or projection analogous to the fixing arm of the hinge and disposed so as to obtain a moment in the opening direction. Advantageous variants include a cam constituted by a separate plastic element fixed to the arm of the hinge or by one or more tabs produced on said arm.

Advantageously, the spring can exert the pushing force during opening directly on the box, on the back of the fixing arm or on the lateral ribs of said arm, disposed adjacent to the head of an eccentric for regulating the hinge.

Once the hinge has reached an open position corresponding to an angle of approximately 15-20°, the spring ceases to exert its pushing force for the remaining movement of the door, no longer exerting a perceptible action, although its action must be overcome in order to close the door again. The hinge of the invention is versatile as it can be applied in various embodiments. The dependent claims describe preferred embodiments of the invention.

BRIEF DESCRIPTION OF THE FIGURES

Further characteristics and advantages of the invention shall become apparent in the light of the detailed description of preferred, although non-exclusive, embodiments of a hinge for furniture units with cornice illustrated, by way of a non-limiting example, with the aid of the accompanying drawings wherein.

DETAILED DESCRIPTION OF PREFERRED EMBODIMENTS OF THE INVENTION

Figure 1:
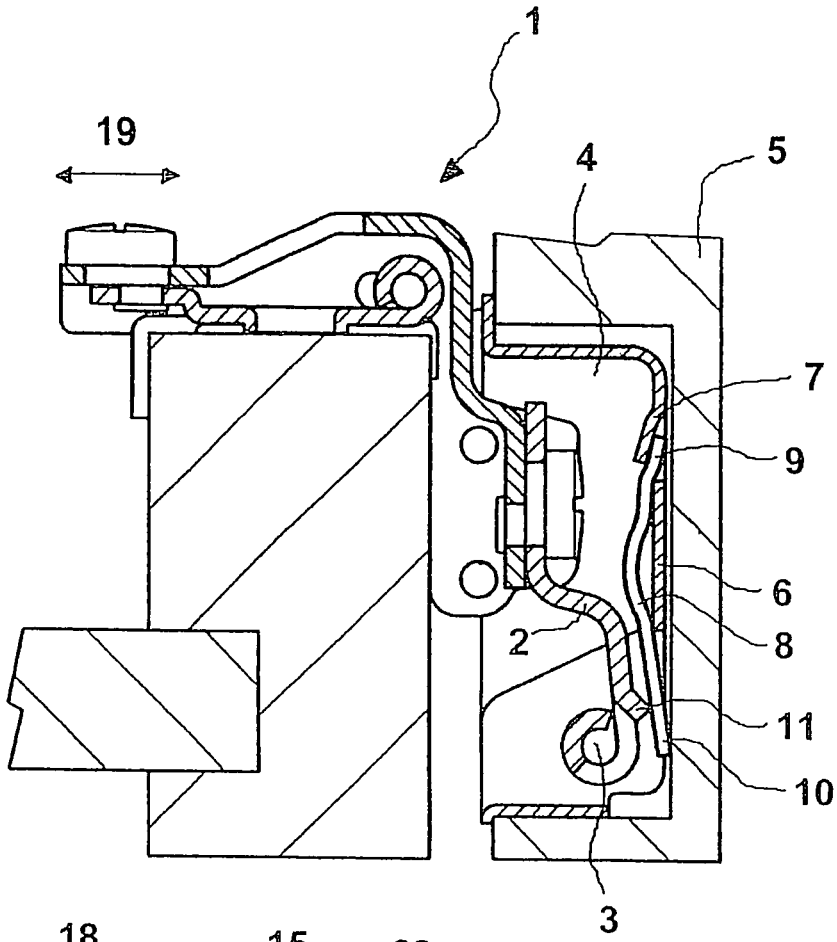
FIGS. 1 and 2 show a hinge according to the invention respectively in a closed position and in a partially open position corresponding to the position in which the spring ceases to exert its force.
Figure 2:
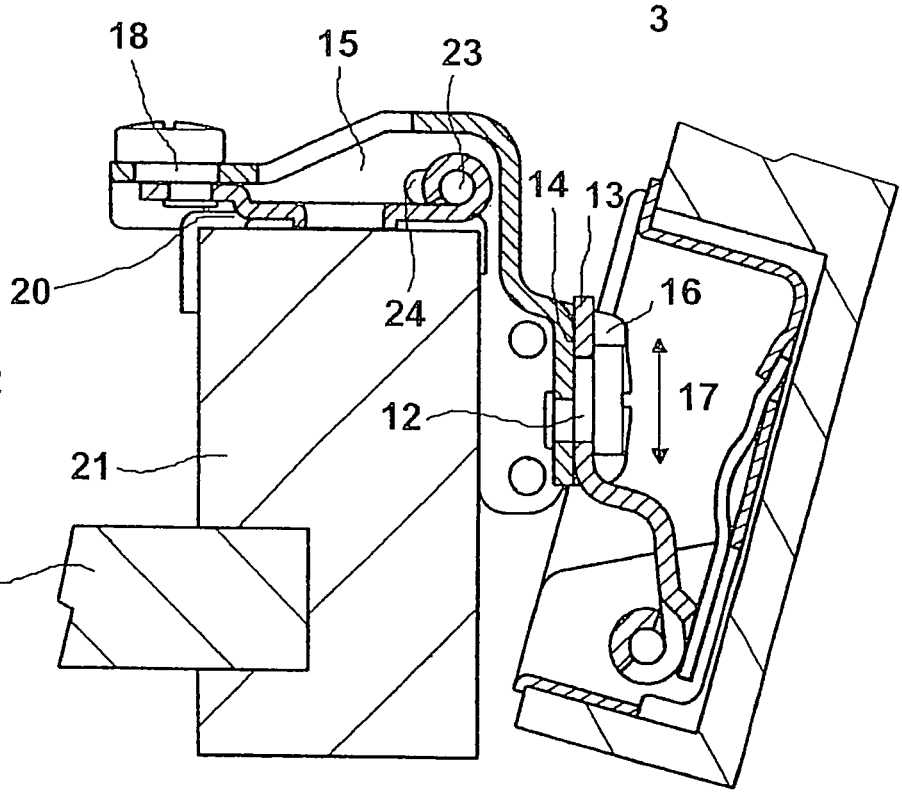

With reference to the figures, a hinge for furniture units with cornice is shown, globally referenced with numeral 1, comprising an arm 2, 15 for fixing to a furniture unit 21, 22. This fixing arm in turn comprises a first arm 15, set on the cornice of the furniture unit, and a second arm 2, the coiled lower end of which encircles a single pivot pin 3, fixed in a known way to the lateral walls of a box or furniture element 4, housed inside a cavity in the door 5 and connected thereto by a flange which is integral with said box. In FIG. 1, on the side opposite the pivot pin 3, the box 4 has a raised part 7 on the base 6 thereof, bent towards the inside of the box, which creates a slot housing a first end 9 of an elastic element or spring 8, for example a flat or steel wire spring. The second end 10 of said spring is disposed in a cutout in the base 6 of the box and rests against a projection 11 of the arm 2. The position and form of this projection is chosen so as to produce a moment on the arm 2 during opening by pivoting of the door 5. The reaction to this moment is such as to push the box 4 towards the open position.

The arm 2, as in FIG. 1, can be produced integrally in one piece in stamped plate metal with one or more tabs 11 projecting from the back of said arm. When the hinge is in the assembled position, the tabs 11 push against the end 11 of the spring 8.

Alternatively, the arm 2 can be formed by at least one part of shaped plate metal on which an insert made of plastic or another suitable material is fixed, appropriately shaped in the form of a cam, in the part resting against the spring 8.

Advantageously, it is possible to fix cams of different types or with different shapes to the shaped part, so that the hinge can be provided with different functions, such as the possibility of using the same spring to produce both an opening force on the door, and a closing force. By pressing on a suitable point of the end of the spring 8 it is, for example, possible to produce a pushing force during opening which makes the door rotate by approximately 15-20° clockwise with reference to the figures. Depending on requirements, the choice of this angle can have values higher or lower than those indicated above.

The door 5 can be provided with a retaining element, such as a spring, magnetic or hook, which holds it closed and when the retaining element is released the pushing force causes opening of the angle predefined by the shape of the cam. For the remainder of opening rotation the spring has no influence on the door.

However, the arm 2 produced in one piece has the advantage of limited production costs, and also eliminates an additional assembly operation.

Consequently, the arm 2 produced as described above provides the hinge with increased versatility.

The position of the arm 2 of the hinge can be regulated longitudinally in the direction of the arrow 17 by means of a first eccentric 12 which allows regulation of the position of the upper end 13 of the arm 2 relative to the front side 14 of the other arm 15, said front side being provided with raised edges or anti-torsion lateral ribs 16. Regulation by means of the eccentric can, for example, be performed using a screwdriver.

A second eccentric 18 instead allows the depth of the hinge to be regulated in the direction of the arrow 19, by fixing the position of the arm 15 with respect to a base plate 29 integral with the cornice 21 of a furniture unit 22 or component thereof. The maximum movement of the arm 15 in this direction is determined by a pin 23 housed in the coiled front end of the base plate 20 which limits this movement thanks to the presence of oblong holes 24 on the lateral wall of the arm 15 in which said pin is inserted.

Advantageously, the arm 15 is fixed to the furniture unit so that it also covers part of the front cornice, consequently guaranteeing increased durability.

Figure 3:
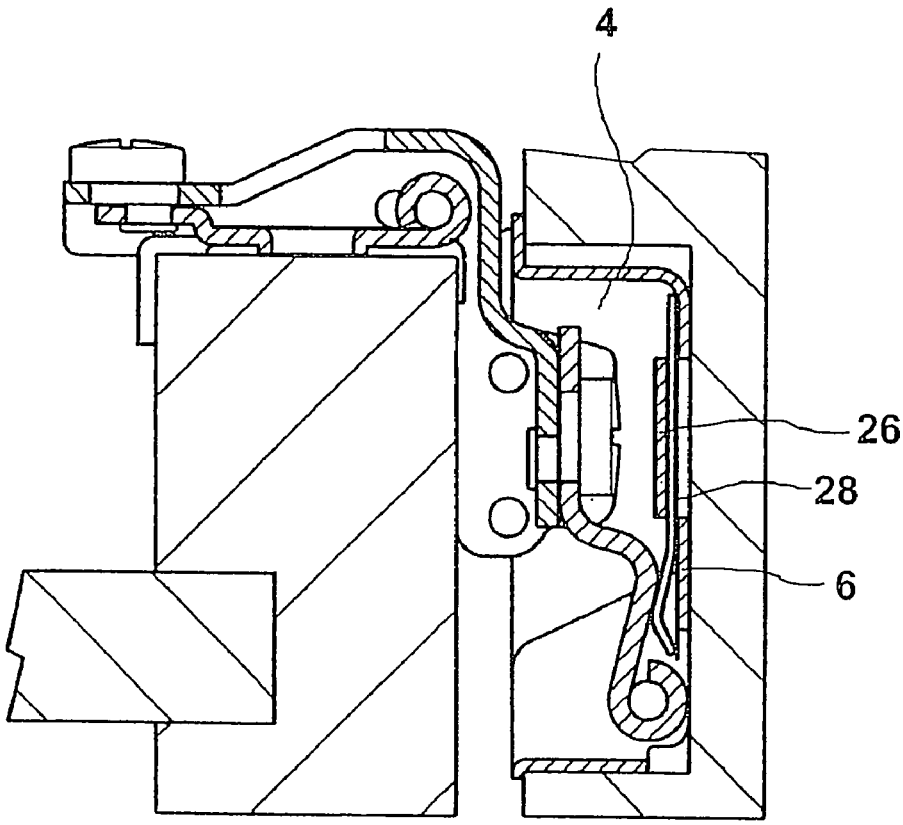
FIGS. 3 and 4 show an embodiment of the hinge of the invention respectively in the two positions of FIGS. 1 and 2.
Figure 4:
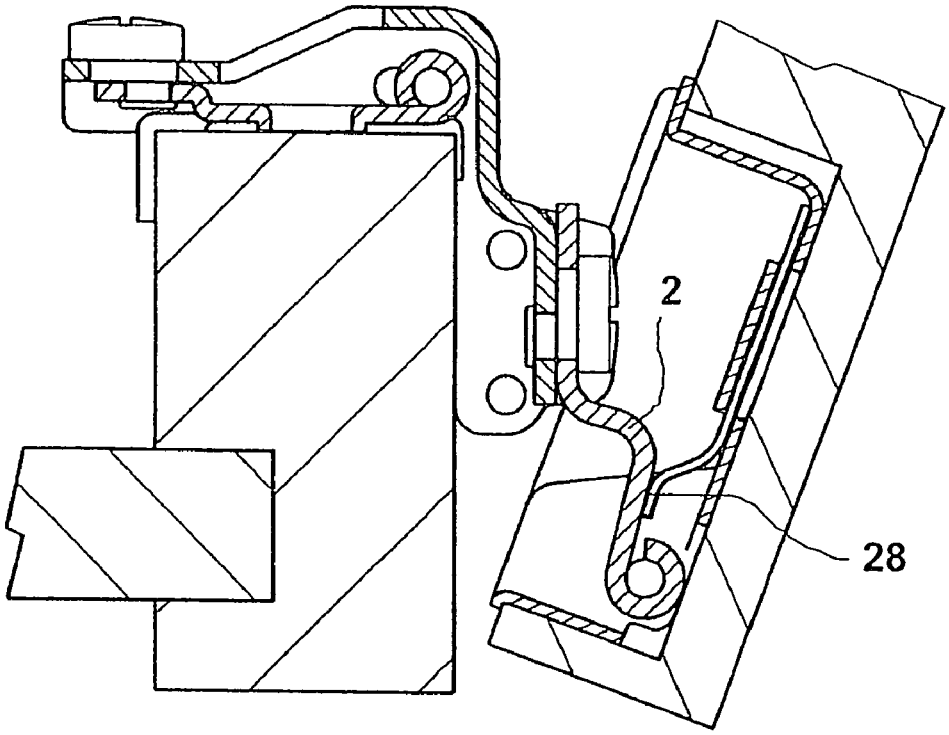

FIGS. 3 and 4 show an advantageous embodiment wherein a spring 28, shorter and thinner, is fixed in the box 4 under a cutaway section of the base 6 thereof. Operation is analogous to the first embodiment, but the spring exerts a pushing force directly on the back of the arm 2. In this variant, therefore, an arm with a simpler shape is used as it does not require the projection 11 and consequently the tabs or cams.

Figure 5:
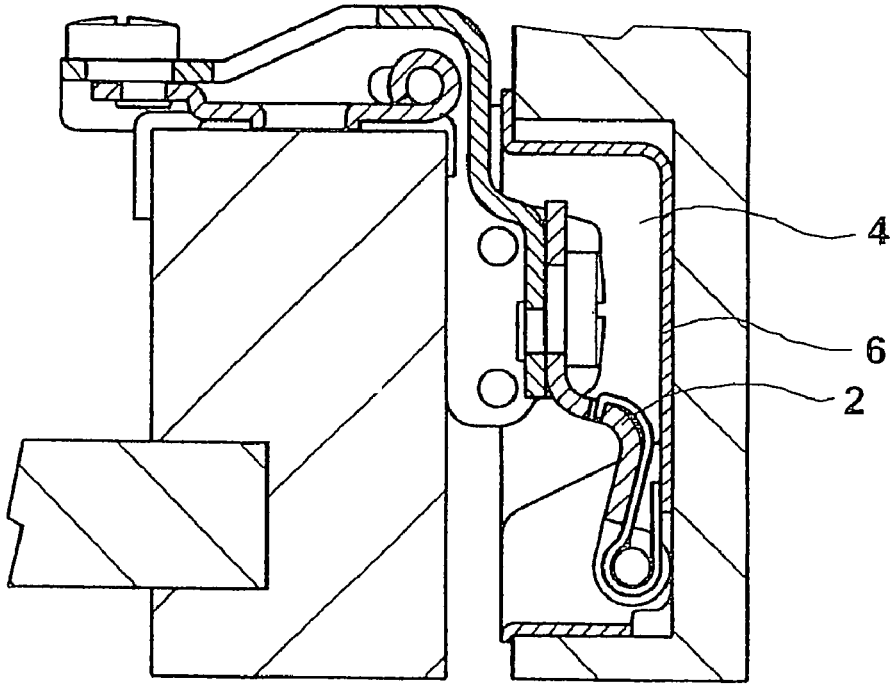
FIGS. 5 and 6 show a second embodiment of the hinge of the invention respectively in the two positions of FIGS. 1 and 2.
Figure 6:
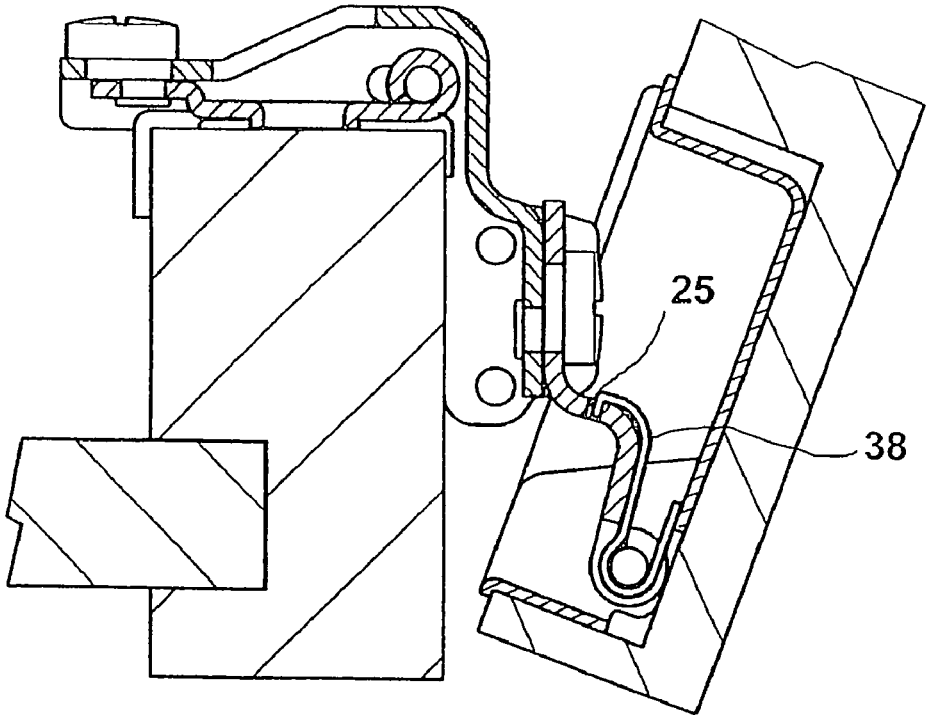
Figure 7:
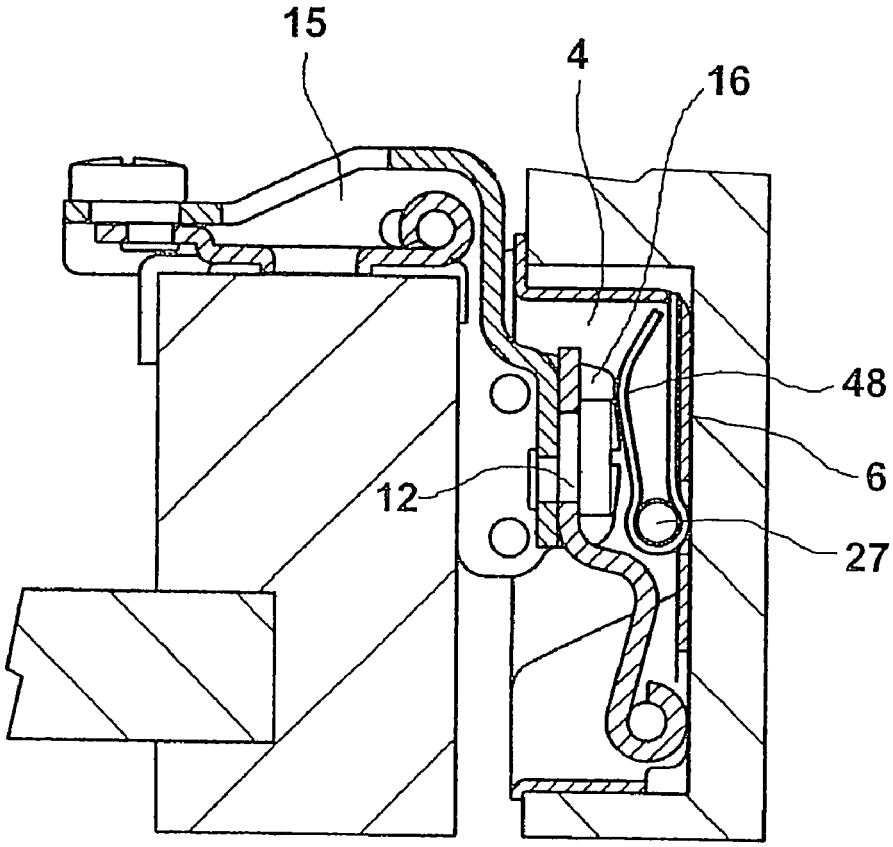
FIGS. 7 and 8 show a third embodiment of the hinge of the invention respectively in the two positions of FIGS. 1 and 2.
Figure 8:
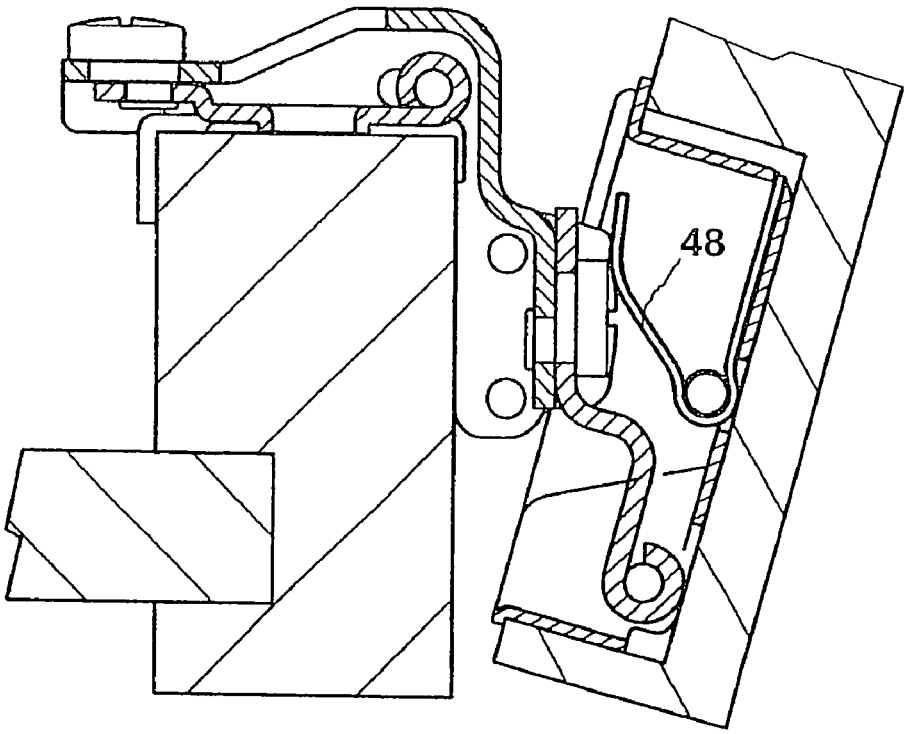

FIGS. 5 and 6 show the hinge of the invention with a different arrangement of the spring. In this case, a V-shaped spring 38 is shaped to adhere to the arm 2 and is fixed thereto with one end in a specific seat 25 produced in said arm, while the other end is capable of exerting an opening force on the base 6 of the box 4. This variant has the advantage of reducing the overall dimensions inside the box 4. Moreover, the arrangement and high rigidity of the spring 38 allow fast opening of the door of the furniture unit. Finally, FIGS. 7 and 8 show a further advantageous variant wherein a spring 48 is housed in the box 4 around an auxiliary pin 27, fixed in a known way to the box. One end of the spring is resting and locked on the base 6 of the box, while the other end is resting on lateral ribs 16 of the arm 15 and capable of exerting a pushing force thereon, said lateral ribs being disposed adjacent to the head of the eccentric 12 for regulation. As with this arrangement the point in which the pushing force takes place is at a greater distance from the pivot pin 3, this variant allows the use of a less rigid spring to produce more gentle opening of the door. All these variants, which come within the scope of the invention, allow simple and relatively uncomplicated construction of the hinge for furniture units with cornice. This results in a limited production cost which allows economies of scale to be obtained. The specific embodiments described herein do not limit the content of this application, which covers all the variants of the invention defined by the claims.

The invention claimed is:

1. Hinge for furniture units with cornice comprising a fixing arm for fixing to a furniture unit, said fixing arm comprising a first fixed arm and a second fixed arm, said second fixed arm comprising a first end, a second end, and a protrusion in a medial position between said first end and said second end, a box fixed to a door of said furniture unit, said fixing arm being fixed to said box so as to allow reciprocal rotation around a first pivot pin between an open position and a closed position, a spring provided with a first end and a second end, the first end of the spring resting against a wall of the box and the second end of the spring resting against the protrusion and pushing against the protrusion to exert a pushing force on the box only for a short arc of said reciprocal rotation corresponding to a first opening portion of the door of approximately 15 -20 degrees in the same direction in which the door opens.

2. Hinge as claimed in claim 1, wherein said protrusion comprises an element in the form of a tab.

3. Hinge as claimed in claim 1, wherein said protrusion comprises an element in the form of a cam in plastic material, appropriately shaped.

4. Hinge as claimed in claim 1, wherein said protrusion is formed by a curvature of the second arm.

5. Hinge for furniture units with cornice according to claim 1, wherein the spring is V-shaped.

6. Hinge for furniture units with cornice according to claim 5, wherein the V-shaped spring is pivoted about the first pivot pin.

7. Hinge for furniture units with cornice comprising a fixing arm for fixing to a furniture unit, said fixing arm comprising a first fixed arm and a second fixed arm, said second fixed arm comprising lateral ribs, a box fixed to a door of said furniture unit, said fixing arm being fixed to said box so as to allow reciprocal rotation around a first pivot pin between an open position and a closed position, a second pivot pin fixed to the box, a V-shaped spring provided with a first end, a second end and housed in the box around the second pivot pin, the first end of the V-shaped spring resting against a wall of the box and the second end of the V-shaped spring resting against the lateral ribs and pushing against the lateral ribs to exert a pushing force on the box only for a short arc of said reciprocal rotation corresponding to a first opening portion of the door of approximately 15-20 degrees in the same direction in which the door opens.

* * * * *